US006192781B1

(12) United States Patent
Thames et al.

(10) Patent No.: US 6,192,781 B1
(45) Date of Patent: Feb. 27, 2001

(54) ASSEMBLY FOR REVERSING A FLUID DRIVEN MOTOR

(75) Inventors: Bruce A. Thames, Cypress; Robert E. Fowler, Houston, both of TX (US)

(73) Assignee: Cooper Technologies Company, Houston, TX (US)

( * ) Notice: Subject to any disclaimer, the term of this patent is extended or adjusted under 35 U.S.C. 154(b) by 0 days.

(21) Appl. No.: 09/223,806

(22) Filed: Dec. 31, 1998

(51) Int. Cl.[7] ..... F15B 13/04

(52) U.S. Cl. ..... 91/30; 91/31; 91/32; 91/428; 91/444

(58) Field of Search ..... 418/32, 270; 73/218, 73/221; 91/30, 31, 32, 428; 60/493

(56) References Cited

U.S. PATENT DOCUMENTS

| | | | | |
|---|---|---|---|---|
| 2,362,389 | * | 11/1944 | Martin | 60/493 |
| 2,476,486 | * | 7/1949 | Ferguson | 173/221 |
| 2,708,345 | * | 5/1955 | Miles | 60/493 |
| 2,731,952 | * | 1/1956 | Szabo | 91/31 |
| 3,181,672 | * | 5/1965 | Swanson | 418/188 X |
| 3,298,284 | * | 1/1967 | Alexander | 418/270 |
| 3,614,275 | * | 10/1971 | Eibsen | 418/270 |
| 3,635,605 | * | 1/1972 | Hall et al. | 418/32 X |
| 3,951,217 | * | 4/1976 | Wallace et al. | 173/169 |
| 3,963,391 | * | 6/1976 | Thorburn et al. | 418/270 |
| 4,591,299 | | 5/1986 | Eckman . | |
| 4,740,144 | | 4/1988 | Biek | 418/270 X |
| 4,772,186 | * | 9/1988 | Pyles et al. | 418/270 |
| 4,799,833 | | 1/1989 | Pennison et al. . | |
| 4,962,787 | * | 10/1990 | Mayhew | 418/270 |
| 5,086,848 | * | 2/1992 | Hudak | 173/93 |
| 5,213,136 | * | 5/1993 | Thorp et al. | 137/625.68 |
| 5,293,747 | * | 3/1994 | Geiger | 60/493 |
| 5,377,769 | * | 1/1995 | Hasuo et al. | 173/169 |
| 5,505,270 | * | 4/1996 | Wentworth | 173/1 |

OTHER PUBLICATIONS

"Operating Instructions and Service Manual –Quackenbush® 15QDA–RAB–SU–RS Positive Feed Drill", Intool Incorporated Manual, pp. 1–23, Jan. 1, 1996.

"Operating Instructions and Service Manual –Cleco® 35TNAL & 35 TNL Tubenut Nutrunners", Intool Operation Manual, pp. 1–13, Aug. 1, 1998.

"Operating Instructions and Service Manual –Cleco® No. 40NLTVC & 40RNLTVC Series Solenoid Controlled Right Angle Nutrunner", Intool Incorporated Manual, pp. 1–23, Oct. 1, 1995.

Operating Instructions and Service Manual –Quackenbush® 230QGDA–RAC–SU–MS, 2300QGDAV–RAC–SU–MS, Intool Incorporated Manual, pp. 1–20, Jul. 1, 1994.

* cited by examiner

*Primary Examiner*—John E. Ryznic
(74) *Attorney, Agent, or Firm*—Coats & Bennett, PLLC

(57) ABSTRACT

An assembly for reversing a fluid driven motor. The assembly includes a fluid driven motor, and a reversing valve that reverses inlet and exhaust porting to and from the fluid driven motor. An actuation device opens an actuation valve and a fluid supply valve. The actuation valve causes the reversing valve to reverse the inlet and exhaust porting to and from the fluid driven motor when the actuation device opens the actuation valve. The fluid supply valve allows fluid to flow through the fluid supply valve to the motor when the actuation device opens the fluid supply valve. The fluid supply valve also prevents fluid flow through the fluid supply valve to the fluid driven motor when the fluid supply valve is closed.

30 Claims, 7 Drawing Sheets

ASSEMBLY FOR REVERSING A FLUID DRIVEN MOTOR

BACKGROUND OF THE INVENTION

1. Field of the Invention

The present invention relates to tools, such as automatic drills, and more particularly, to a method and apparatus for reversing a fluid driven motor of such tools.

2. Description of the Related Art

Fluid driven motors, such as air driven or liquid driven motors, are widely used in industry, particularly in portable tools. For example, radial vane air motors, or pneumatic motors, are used in portable air tools, such as nut runners and right angle positive feed drills. In many instances, it is desirable to reverse the motor of such tools. For instance, with some right angle positive feed drills, reversing the air motor causes a spindle and drill bit to rapidly advance toward a workpiece. Rapidly advancing the drill bit toward the workpiece saves considerable time because, without the rapid advance option, an operator of the tool must wait for the spindle to advance slowly toward the workpiece during a drilling cycle. Hence, many conventional tools include an air motor that is reversible.

Conventional reversible air motors typically include a bearing plate having an axially oriented inlet port and an axially oriented outlet port. Such air motors are run in a forward direction by directing air flow through the inlet port and by permitting exhaust air to exit the outlet port. To reverse such air motors, the air flow is shut off and the air porting is changed such that air will flow into the outlet port rather than the inlet port. In this case, the motor will turn in reverse and the inlet port will function as an exhaust port. This rerouting of the the air flow is typically achieved by an operator manually moving a switch or other similar device to directly move a ring located adjacent to the bearing plate having the inlet and outlet ports. After the operator has reversed the porting, the air supply is turned on to run the motor in reverse. Thus, two manual steps are required to reverse the air motor.

Other conventional tools use other approaches to reverse an air motor. For example, one such tool includes what is typically considered a non-reversible air motor. This air motor includes an axially oriented inlet port, but does not include an axially oriented outlet port as it is typically designed to rotate in one direction. Thus, the air motor includes a plurality of exhaust slots located along the periphery of air motor's housing. This air motor is run in a forward direction by directing air flow through the inlet passage and out of the above-described exhaust ports. To reverse this type of air motor, a shifting lever is actuated by an operator, which opens a ball valve. The opening of the ball valve permits pressurized air to flow into a deflector cavity. The pressurized air in the deflector cavity imposes a force against a pressure-actuated exhaust deflector that is slidably mounted on the outside of the motor housing. The exhaust deflector is moved and closes off the atmospheric exhaust route normally used during forward rotation of the motor. The incoming pressurized air in the deflector cavity is then routed to the normal exhaust slots of the motor such that the motor operates in reverse. Although this reversing method adequately reverses the motor of the tool, it requires many complicated parts in order for the reversing operation to function properly. For instance, the above-described construction requires kick-out springs in the motor to keep the blades thrown against the wall of the motor.

In yet another conventional approach to reversing an air motor of a tool, an operator actuates a button to cause a spool valve to reroute air flow to the inlet and outlet ports of a reversible air motor. However, this approach tends to reduce the power of the air motor, unless the spool valve is overly large. Additionally, this approach of reversing the air motor requires that the operator turn on the flow of pressurized air to the motor by actuating another device, such as an air valve.

Thus, it is apparent that conventional tools having a reversible air motor generally require two separate steps to reverse the motor—reversing the porting to the motor, and then supplying air to the motor to run it in reverse. These separate steps may create manufacturing problems and even damage the tool if the operator performs these steps in the wrong order or in combination with another sequence, such as a drilling cycle. Furthermore, conventional tools having an actuator that both reverses the porting to and from the air motor and supplies air to the motor are overly complicated. The above-described constraints and problems associated with conventional tools has created a need for a new approach to reverse an air motor.

SUMMARY OF THE INVENTION

Generally speaking, the present invention provides an assembly for reversing a fluid driven motor, such as an air motor or a liquid driven motor.

According to one aspect of the present invention, an assembly for reversing an air motor includes a housing having an air supply channel, and an air motor having a first air passageway and a second air passageway. The air motor rotates in a first direction when air is supplied to the first air passageway from the air supply channel. The air motor rotates in a second direction opposite to the first direction when air is supplied to the second air passageway from the air supply channel. A reversing valve is pneumatically moveable from a first position to a second position. The reversing valve has at least one port that communicates the air supply channel with the first air passageway when the reversing valve is located in the first position. The reversing valve prevents air flow from the air supply channel to the first air passageway and communicates the air supply channel with the second air passageway when the reversing valve is located in the second position. The reversing valve moves from the first position to the second position when an actuation valve opens. The reversing valve is movable from the second position back to the first position when the actuation valve closes. An air supply valve communicates the air supply channel with one of the first air passageway an the second air passageway when the air supply valve opens. An actuation device opens the actuation valve and the air supply valve.

According to another aspect of the present invention, an assembly for reversing a fluid driven motor includes a fluid driven motor, and a reversing valve for reversing an inlet port to the motor and an exhaust port from the motor. The assembly further includes an openable and closeable actuation valve, an openable and closeable fluid supply valve, and an actuation device for opening the actuation valve and the fluid supply valve. The actuation valve causes the reversing valve reverse the inlet and exhaust porting to and from the fluid driven motor when the actuation device opens the actuation valve. The fluid supply valve allows fluid to flow through the fluid supply valve to the motor when the actuation device opens the fluid supply valve. The fluid supply valve prevents fluid flow through the fluid supply valve to the fluid driven motor when the fluid supply valve is closed.

In accordance with another aspect of the present invention, an assembly for reversing a fluid driven motor includes a fluid driven motor, and a throttle valve in communication with a fluid flow supply channel located upstream of the throttle valve with respect to a direction of fluid flow. The throttle valve is openable and closeable. The throttle valve directs fluid flow to the motor from the fluid flow supply channel to rotate the motor in a forward direction when the throttle valve is opened. An actuation valve causes a reversing valve to reverse an inlet port to the motor and an exhaust port from the motor when the actuation valve is actuated. The actuation valve is in communication with the fluid supply channel at a location upstream of the throttle valve.

According to a further aspect of the present invention, an assembly includes a fluid driven motor. The motor has a rear bearing plate and a rotor. The rear bearing plate has an inlet port and an exhaust port when the motor rotates in a forward direction. The assembly also includes a fluidly actuated reversing valve. The reversing valve is rotatable about an axis substantially parallel with an axis of the rotor. The reversing valve directs fluid flow to the exhaust port when the reversing valve is rotated from a first position to a second position. The motor rotates in a reverse direction when fluid flow is supplied to the exhaust port.

Another aspect of the present invention involves a method of reversing a fluid driven motor assembly. The fluid driven motor assembly has a first fluid passageway, a second fluid passageway, and a fluid supply channel. The fluid supply channel is in communication with the first fluid passageway when the motor turns in a forward direction. The method includes the step of moving one lever to: (1) open a first valve to communicate the fluid supply channel with the second fluid passageway; and (2) open a second valve to supply fluid flow from the fluid supply channel to the second fluid passageway to turn the fluid driven motor in reverse. The first valve may open before, after, or simultaneously with the second valve.

Other objects, advantages and features associated with the present invention will become readily apparent to those skilled in the art from the following detailed description. As will be realized, the invention is capable of other and different embodiments, and its several details are capable of modification in various obvious aspects, all without departing from the invention. Accordingly, the drawings and the description are to be regarded as illustrative in nature, and not limitative.

DETAILED DESCRIPTION OF THE PREFERRED EMBODIMENT

The present invention relates to a method and apparatus for reversing fluid driven motors, such as liquid driven motors and pneumatic motors. According to a preferred embodiment of the present invention, an assembly 24 for reversing a radial vane air motor 22 is preferably incorporated into a portable tool, such as the right angle positive feed drill 20 illustrated in FIG. 1. The apparatus and method of the present invention are also applicable to other types of tools. For example, the assembly 24 for reversing the air motor 22 may be used with and incorporated in a nut runner, such as model number 35TNAL Tube Nut Nutrunner, commercially available from Cooper Power Tools, Intool Division, Houston, Tex. USA. Right angle positive feed drills that the assembly 24 for reversing the air motor 22 may be incorporated in are described in U.S. Pat. Nos. 4,799,833 and 4,591,299, the entire disclosures of which are hereby incorporated by reference. The following description of the assembly 24 for reversing the air motor 22 is applicable to other motors that are driven by other fluids, such as liquids and other gases.

Figure 1:
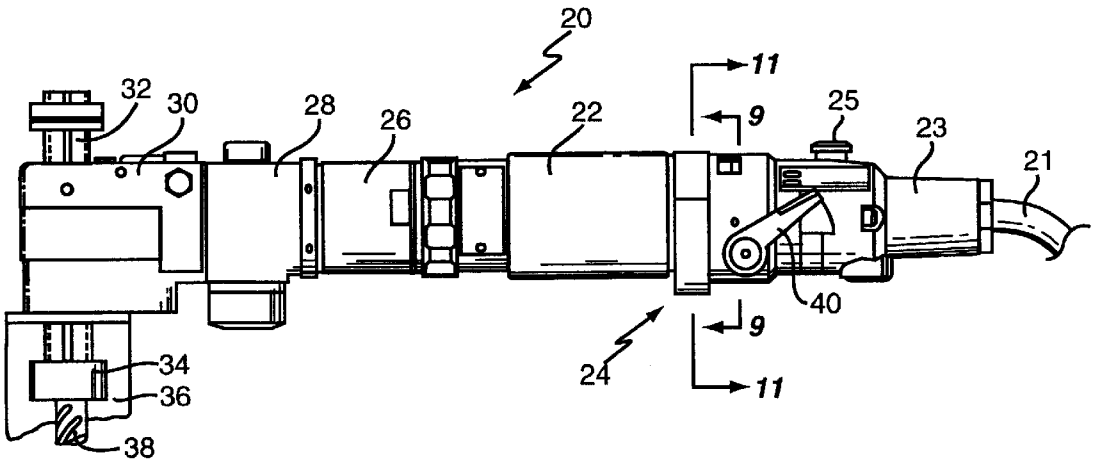
FIG. 1 is a side view of a right angle positive feed drill having a assembly for reversing an air motor according to one embodiment of the present invention.

As illustrated in FIG. 1, the right angle positive feed drill 20 includes a reversible motor 22, planetary gears 26, a positive feed drill head 30, a reciprocating spindle 32, a housing 28, a drill chuck 34, a tool nose 36, and a drill bit 38, which all operate to drill a hole in a work piece. The tool 20 is connected to an air supply line 21 which supplies pressurized air to rotate the air motor 22. The construction of the portions of the right angle positive feed drill 20, except for the assembly 24 for reversing the air motor 22 and the rear housing 23, is mostly conventional, and will only be briefly described herein.

Figure 16:
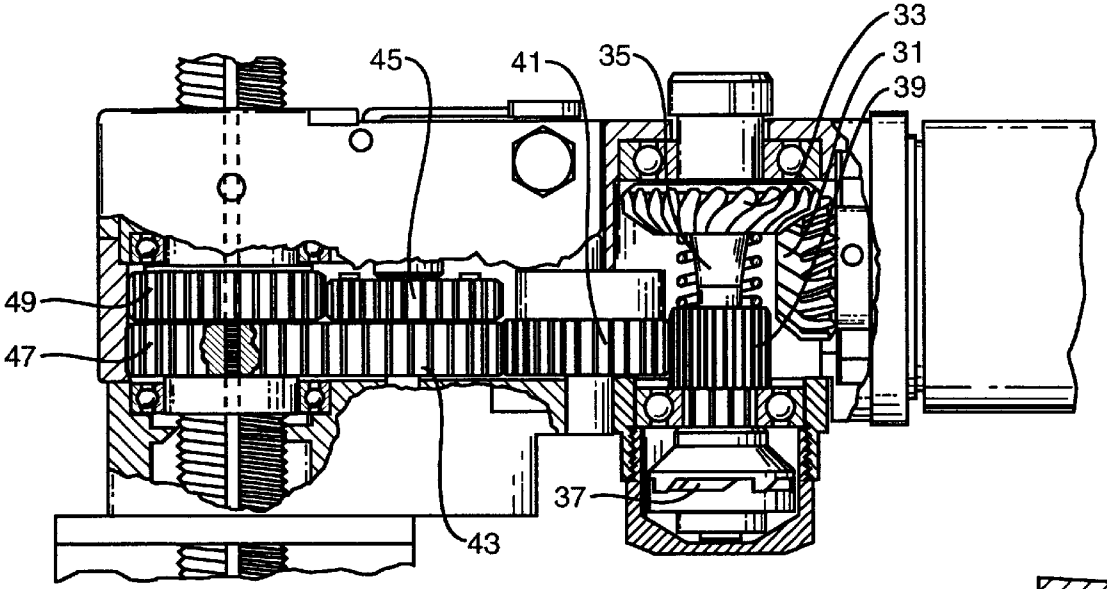
FIG. 16 illustrates the internal structure of the positive feed drill head of the right angle positive feed drill illustrated in FIG. 1.

FIG. 16 illustrates a cut-away view of the drill head 30. The various gears illustrated in FIG. 16 operate to rotate, feed, and retract the spindle 32. In forward operation, or the drilling mode, the motor 22 turns in a clockwise direction (as viewed from the rear of the tool 20), driving the planetary gear reduction 26 which in turn drives the pinion 31. Pinion 31 drives the gear 33 which is pinned or keyed to clutch shaft 35. Also positioned on the clutch shaft 35 is a clutch 37. A series of gears connects the shaft 35 with the spindle 32. Spur pinion 39 drives idler gear 41 which drives the main gear 43. In forward drill mode, the main drive gear 43 is engaged with the feed gear 45 so that they turn in unison. The main drive gear 43 is also engaged with a spindle rotation gear 47. The spindle rotation gear 47 slips over the spindle 32 and is attached by lugs or keys that are disposed in four slots formed in the exterior of the spindle. This attachment allows transmission of rotational motion to the spindle 32 while permitting the spindle 32 to move longitudinally through spindle rotation gear 47.

Also mounted on spindle 32 is a spindle feed gear 49 that has interior threads to match with the exterior threads of the spindle 32. Spindle feed gear 49 is driven by feed gear 45 while in the forward position as shown in FIG. 16. Spindle feed gear 49 threads the spindle 32 through the gear 47 and feeds it toward the workpiece. A differential exists between the spindle rotation gear 47 and the spindle feed gear 49 to allow the spindle 32 to be rotated and to be advanced toward the workpiece.

To retract the spindle 32, the motor 22 remains running forward but the feed gear 45 is urged upward such that it disengages from the main drive gear 43. The feed gear 45 may be moved upward by an operator actuating a lever or by other means. When the feed gear 45 is moved upward it is stopped from rotating and is locked in a stopped position. Since the feed gear 45 has stopped, the spindle feed gear 49 also stops turning which causes the spindle 32 to rotate through the internal threads of a spindle feed gear 49 and retract away from the workpiece.

A feature of the right angle feed drill 20 is that it has the ability to rapidly advance the drill bit 38 from a retracted position to a position toward the workpiece. This feature is disclosed in both U.S. Pat. No. 4,799,833 and U.S. Pat. No. 4,591,299. With the spindle 32 retracted upwardly, the reversible motor 22 is started in the reverse direction. The feed gear 45 remains in the up and locked position so that it is not engaged with the main drive gear 43. Spindle feed gear 49 is also stopped and does not rotate. With the motor 22 running in reverse, spindle rotation gear 47 rotates the spindle 32 through the internal threads of the spindle feed gear 49 in a reverse direction. This rapidly advances the spindle 32 and the drill bit 38 toward the workpiece.

The right angle positive feed drill 20 also includes the clutch 37 that will slip or disengage when the drill encounters excessive torque during the rapid advance cycle with the motor running in reverse. The clutch 37 is of the conventional type and is oriented perpendicular to the axis of the air motor 22. In a preferred embodiment of the present invention, the clutch 37 is located generally parallel to the axis of the air motor 22.

As illustrated in FIG. 1, the right angle positive feed drill 20 includes a lever 40 that, when actuated, causes the right angle positive feed drill 20 to enter into the above-described rapid advance mode. That is, upon actuation of the lever 40, the air motor 22 will be reversed to cause the right angle positive feed drill 20 to rapidly advance the spindle 32. The motor 22 is reversed by the air motor reversing assembly 24.

Figure 2:
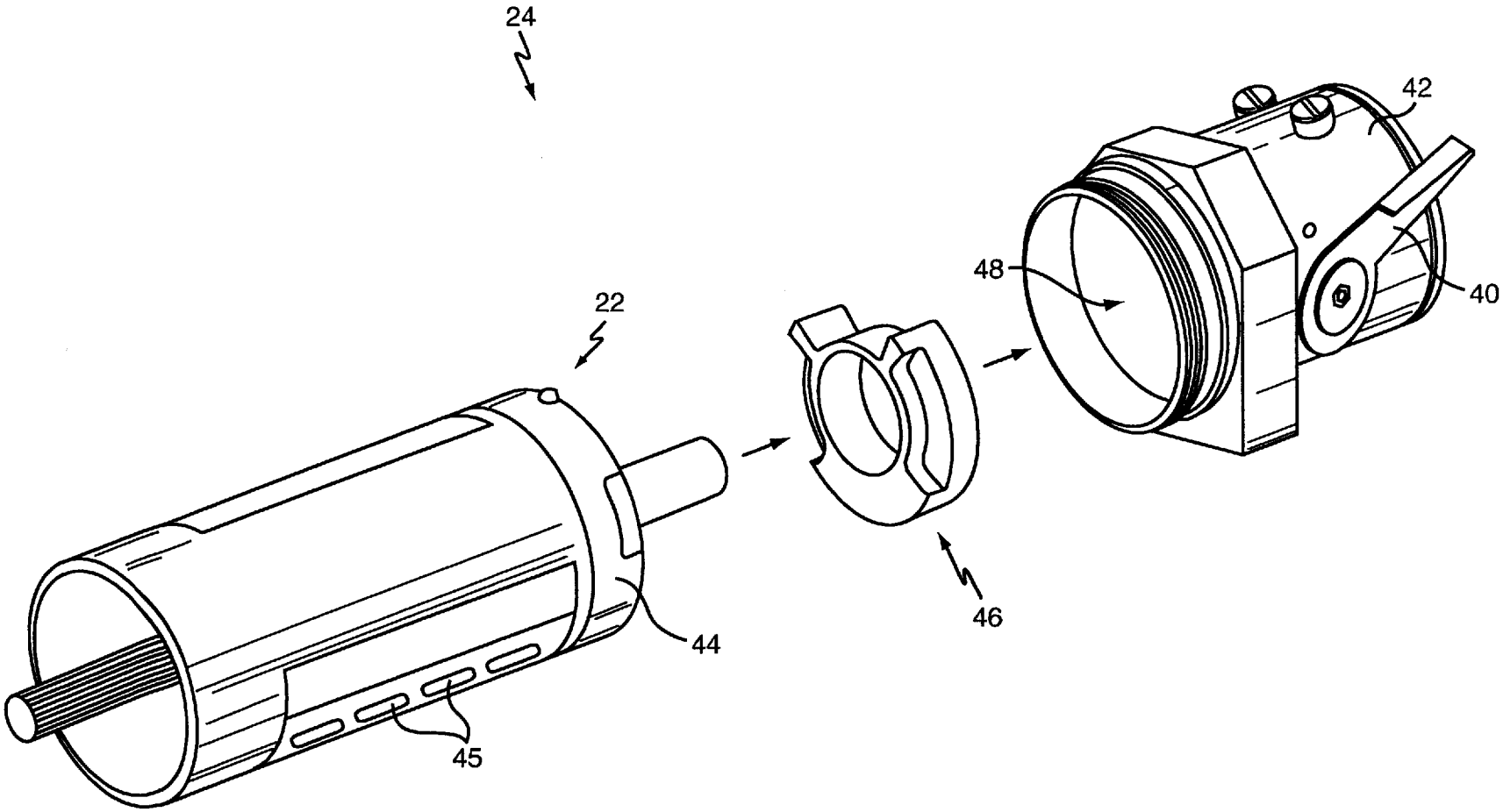
FIG. 2 is an exploded assembly view of an assembly for reversing an air motor according to one embodiment of the present invention.

FIG. 2 illustrates an air motor reversing assembly 24 according to one embodiment of the present invention. As shown in FIG. 2, the air motor reversing assembly 24 includes a housing 42, a reversing valve 46, and an air motor 22. The air motor 22 includes a rear bearing plate 44, similar to conventional reversible air motors. The housing 42 includes a hollow interior 48 that receives the reversing valve 46 and a portion of the air motor 22. As described further below, when assembled, the reversing valve 46 abuts against the rear bearing plate 44, and rotates relative to the rear bearing plate so as to reverse the porting to and from the air motor 22. The actuation of the lever 40 causes the reversing valve 46 to rotate, which reverses an inlet port to the air motor 22 and an exhaust port from the air motor. Additionally, the actuation of the lever 40 causes pressurized air to enter the air motor 22 such that it rotates in a reverse direction. The reversing valve 46 is preferably pneumatically actuated.

Figure 3:
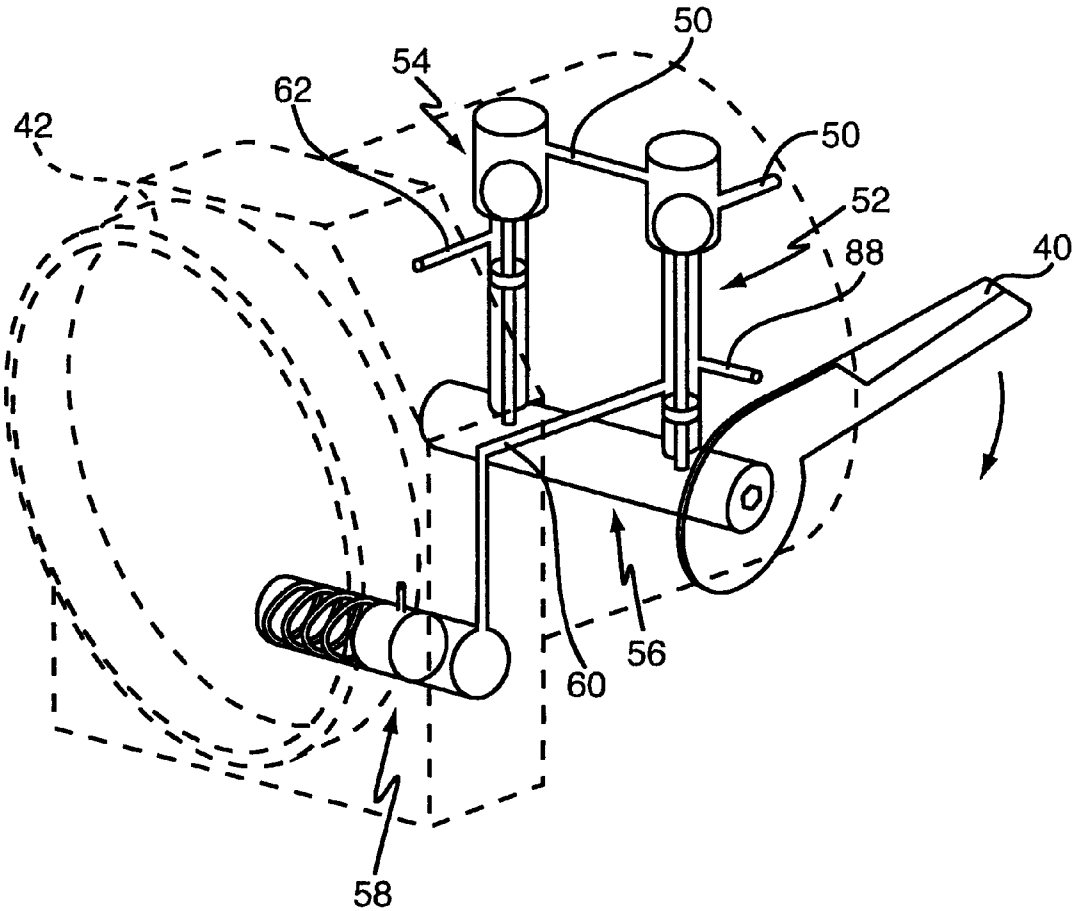
FIG. 3 is a schematic view of the pneumatic channels of an air motor reversing assembly according to one embodiment of the present invention, where the housing of the assembly is shown in hidden lines.
Figure 4:
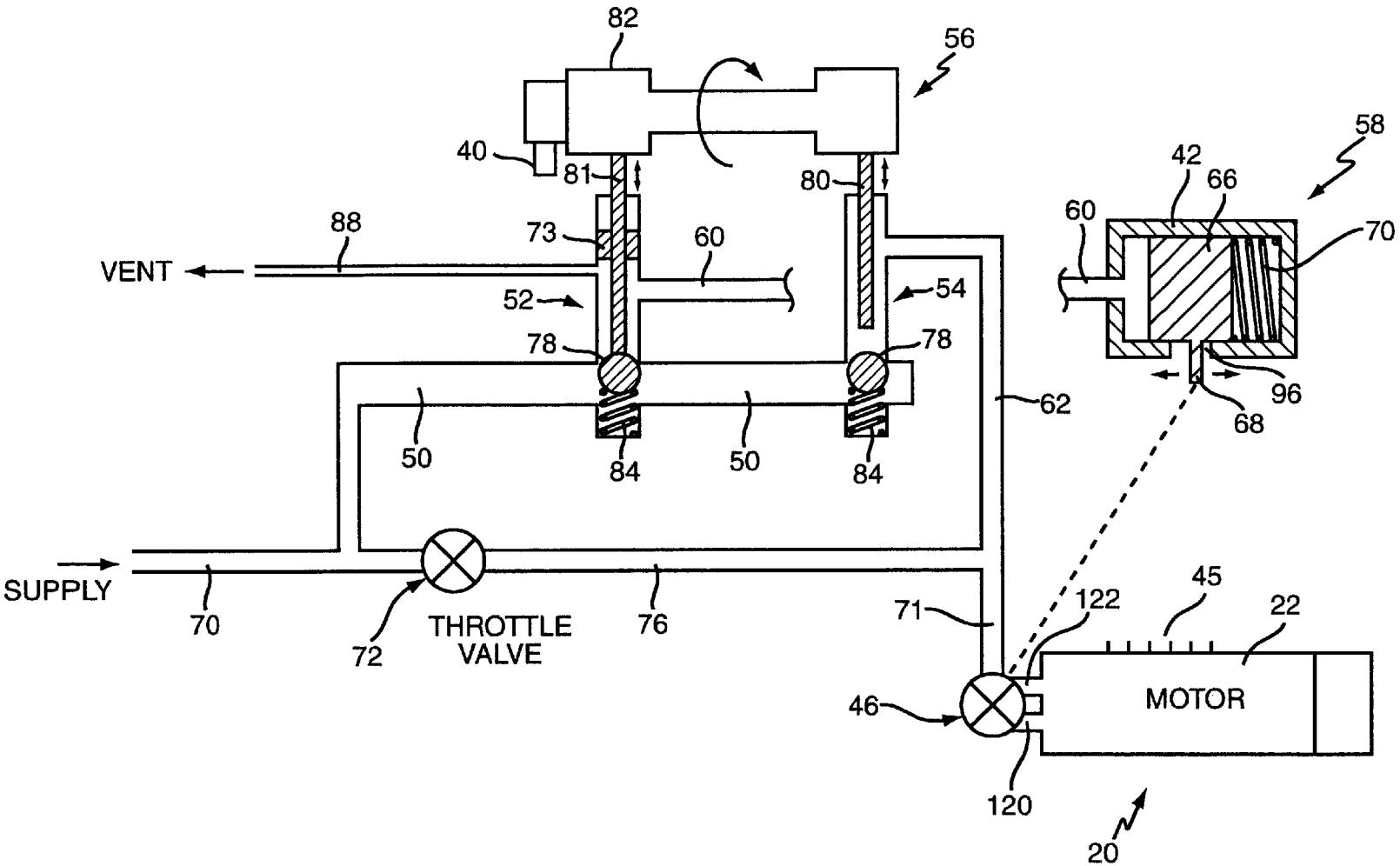
FIG. 4 illustrates a pneumatic circuit diagram of an assembly for reversing an air motor according to one embodiment of the present invention.
Figure 17:
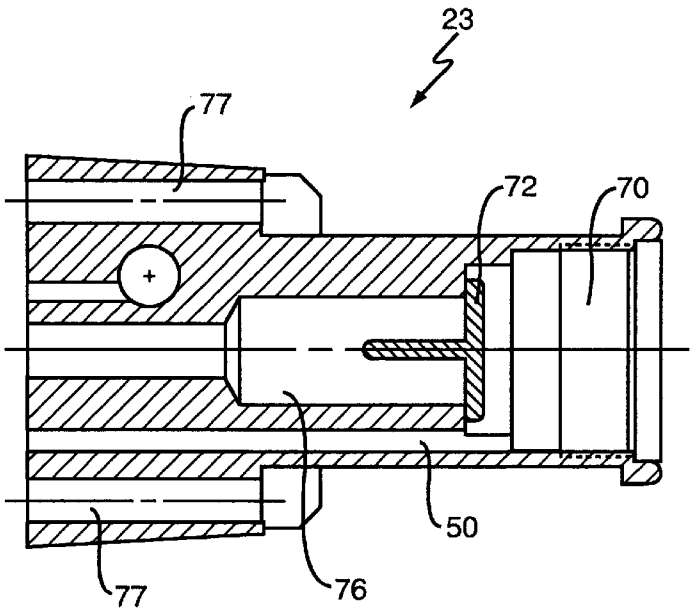
FIG. 17 illustrates a simplified cross-sectional view of the rear housing o the positive feed drill illustrated in FIG. 1.

FIG. 3 illustrates the air or pneumatic channels of the housing 42 (the periphery of the housing 42 is shown roughly by hidden lines). The channels shown in FIG. 3 may be the tubular passageways illustrated or any variety of shaped routes, corridors, conduits, ducts, or grooves. Additionally, the air channels may extend outside the housing via a tube, line or other physical conduit. Many of the channels in the housing 42 have been omitted for purposes of illustration. For example, the housing 42 includes many other channels that were created during machining of the illustrated channels. The air channels shown in FIG. 3 may be made by machining or by a variety of molding processes. FIG. 4 shows a pneumatic circuit diagram of the air motor reversing assembly 24 that illustrates the function of the various air channels shown in FIG. 3, as well as the function of the channels shown in FIG. 17.

FIGS. 3 and 4 illustrated an reversing device 58 that causes the reversing valve 46 to rotate and thus change the porting to and from the air motor 22. As shown in FIGS. 3 and 4, the reversing device 58 preferably includes a piston 66 that is pneumatically moved by supplying air pressure to one side of the piston 66. As the piston 66 is mechanically connected to the reversing valve 46, the reversing valve rotates when the piston is pneumatically moved. Hence, the reversing valve 46 is pneumatically moveable. Immediately after the porting to and from the air motor 22 has been reversed, air flow may be supplied to the motor 22 to cause the motor to rotate in reverse. In reference to FIGS. 3 and 4, an explanation follows of how the reversing assembly 24 causes the reversing valve 46 to rotate and how the reversing assembly 24 causes air flow to be supplied to the motor 22.

Air is supplied to the housing 42 of the reversing assembly 24 by the primary air supply channel 70. The primary air supply channel 70 is located in the rear housing 23 of the tool 20 (see FIG. 17). The housing 42 of the reversing assembly 24 connects to the rear housing 23 so that air from the primary air supply channel 70 may be delivered through the housing 24 and on to the motor 22. The rear housing includes the bores 77 that each receive a bolt or screw for connecting the housing 23 to the housing 42. The primary air supply channel 70 is connected to the air supply line 21, which supplies pressurized air to the tool 20 from an external air supply source (not illustrated). For the right angle positive feed drill 20, air is preferably supplied so that when the tool is running the dynamic pressure at the inlet of the tool is roughly 90 psig.

The primary air supply channel 70 is located upstream of a throttle valve 72. The throttle valve 72 may be any of a variety of valves that, when actuated, permits air to flow to the motor to run the motor in the drill mode during which the air motor 22 rotates in a forward direction. For example, the throttle valve 72 may be the tilt valve illustrated, or may be a ball valve, a spool valve, or other type of valve. The throttle valve 72 may be manually controlled to turn on and the supply to air to the motor 22 to run the motor in a forward direction. Additionally, the throttle valve may be controlled to open for a predetermined period of time by an operator actuating a start button 25. Upon actuation of the throttle valve 72, air from the primary air supply channel 70 travels through an air channel 76 in the housing 42 and the housing 23. Thus, when opened, the throttle valve 72 communicates the primary air supply channel 70 with the air channel 76. The air channel 76 is in communication with an air supply channel 71 in the housing 42 that supplies air to the motor 22. When air flow is supplied to the the air supply channel 71 to the inlet port 120 of the motor 22, the motor will turn in the forward direction, such as during normal drilling of a workpiece. Typically, an operator will actuate the start button 25 shown in FIG. 1 to open the throttle valve 72, and the tool 20 will proceed to execute a predetermined drill cycle where the spindle 32 and drill bit will advance and rotate at a predetermined rate, and then retract from the workpiece. When a drill cycle is complete or when the operator lets off of a manual throttle, the throttle valve 72 will close, preventing air flow to the motor 22 through the air supply channel 76. When the throttle valve 72 is closed, the motor 22 will not rotate unless the reversing assembly 24 causes the motor to rotate in a reverse direction.

The air motor 22 typically includes a first air passageway, such as the inlet port 120 and a second air passageway, such as the exhaust port 122. The air motor will rotate in a forward direction when air flow is supplied to the inlet port 120, and will rotate in a reverse direction when air is suppled to the exhaust port 122. The inlet and exhaust ports 120, 122 are essentially openings, channels, or passageways for air flow to and from the interior of the air motor 22. The inlet port 120 and the exhaust port 122 are preferably located in the rear bearing plate 44, shown in detail in FIGS. 2 and 11–13.

During a normal drill cycle of the tool 20, air is supplied to the inlet port 120 from the air supply channel 71 when the throttle valve 72 opens to communicate the primary air supply channel 70 with the air channel 76. To reverse the air motor 22, the reversing assembly 24 reroutes or directs the air supply to the exhaust port 122 such that the motor will rotate in reverse when air flow is supplied to the exhaust port. This is done by rotating the reversing valve 46 from a first position to a second position and supplying air to the air supply channel 71. This rotation of the reversing valve 46 and directing of air to the motor 22 occurs when the lever 40 is actuated.

As shown in FIGS. 3 and 4, upon actuation of the lever 40, an actuation device 56 causes an actuation valve 52 and an air supply valve 54 to open. The first and second valves 52, 54 have a similar construction and each include a spherical ball 78 that rests against a valve seat. The spherical balls 78 are each biased against a valve seat by a spring 84. The valves 52, 54 open when the respective balls 78 lift off of the valve seats. Although the valves 52, 54 shown in the Figures are preferred, other valves will also suffice. For example, the valves 52, 54 may be spool valves or tilt valves. In general, the valves 52, 54, like the other valves in the assembly 24, may be any of the various devices that regulate the flow of gases or liquids through piping or apertures by opening, closing, or obstructing ports or passageways.

As shown in FIGS. 3 and 4, the primary air supply channel 70 is in communication with the actuation valve 52 and the air supply valve 54 via a reversing valve air supply channel 50. The reversing valve air supply channel 50 connects with the primary air supply channel 70 upstream of the throttle valve 72 (see FIG. 17). Thus, the air supply channel 50 can supply air flow independent of the operation of the throttle valve 72. The reversing valve air supply channel 50 is thus located in the housing 42 and the housing 23. During normal forward operation of the motor 22, the actuation valve 52 and the air supply valve 54 are normally closed, i.e, they each prevent air flow through the valve. As shown in FIGS. 3 and 4, upon actuation of the lever 40, the actuation device 56 causes a pin 81 to move the ball 78 of the actuation valve 52 away from the seat so as to open the valve. This causes air flow from the primary air supply channel 70 to travel through the reversing valve air supply channel 50 and into the air passageway defined by the bore of the valve. The bore of the actuation valve 52 communicates a reversing air channel 60 with the reversing valve air supply channel 50. With the valve 52 still open, the air flow will continue through the valve and enter the reversing air channel 60, which leads to the reversing device 58.

The reversing device 58 causes the porting to and from the air motor 22 to be reversed so that when air is supplied to the motor it will run in reverse. According to a preferred embodiment, the reversing device 58 rotates the reversing valve 46 by pneumatic force. The reversing device 58 includes a fluidly or pneumatically actuated piston 66 that is forcibly moved by pressure. The piston 66 includes a dowel pin 68 that moves with the piston and causes the reversing valve 46 to move from a first position to a second position so as to reverse the porting to and from the motor 22. The reversing device 58 may be other configurations; for example, the reversing device may be integral with the reversing valve 46 so that no intermediate member is needed to move the reversing valve 46. In this case, air pressure from the reversing air channel 60 would force against a surface of the reversing valve 46 to cause it to move, rather than forcing the piston 66 to move which in turn causes the reversing valve 46 to move. Additionally, the reversing device 58 may be a pneumatically rotatable device that is geared to rotate the reversing valve 46.

The reversing valve air supply channel 50 is also in communication with the air supply valve 54. The air supply valve 54 is located downstream of the actuation valve 52 with respect to a direction of air flow. However, the air supply valve 54 could also be located upstream of the actuation valve and still function as contemplated herein. The air supply valve 54 is for supplying air flow to the motor to run the motor in reverse. As shown in FIGS. 3 and 4, the actuation device 56 also causes a pin 80 to lift the ball 78 of the air supply valve 54 such that air from the primary air supply channel 70 flows through the reversing valve air supply channel 50 and then through the bore of the air supply valve 54. The bore of the air supply valve 54 communicates the reversing valve air supply channel 50 with a reverse air supply channel 62, which in turn connects with the air supply channel 71. Thus, if the air supply valve 54 is opened, air will flow from the reversing valve air supply channel 50 to the air supply channel 71. The reverse air supply channel 62 provides air flow to the air supply channel 71. Because the reversing valve 46 is in the process of or has already reversed the porting to and from the air motor 22 upon the opening of the actuation valve 52, the opening of the air supply valve 54 will supply air to the exhaust port 122 of the motor to operate the motor in the reverse. These two steps occur upon actuation of the lever 40.

In the preferred embodiment of the present invention, the actuation valve 52 is actuated before the air supply valve 54 so that the porting is reversed prior to supplying air flow to the motor 22. During normal operation of the tool 20, the throttle valve 72 is typically closed when attempting to reverse the air motor 22 with the lever 40. By slightly actuating the lever 40, the actuation device 56 opens the actuation valve 52 so that air flow is first supplied to the reversing device 58 to shift the porting to and from the air motor 22. Thereafter, further actuation of the lever 40 causes the air supply valve 54 to open and provide air to the motor such that it runs in reverse. As described below, if an operator quickly and fully actuates the lever 40, the actuation valve 52 will open slightly before the air supply valve 54.

During normal operation of an automatic tool, such as the tool shown in FIG. 1, an operator will initiate a start cycle by actuating the start button 25. The tool will then go through a normal drill cycle by delivering air to the motor 22 such that it rotates in a forward direction and drills until it reaches a depth stop. The tool 20 is then triggered into a retract mode. After the drill bit 38 is fully retracted, an air logic system of the tool 20 is vented and the throttle valve 72 is shut off. It ordinarily takes a considerable amount of time to cause the drill bit 38 to approach a workpiece by simply initiating a drill cycle of the tool 20. Hence, it is desirable to rapidly advance the drill bit 38 toward the workpiece and then initiate a drill cycle. To actuate rapid advance of the spindle 32, the start button of the tool 20 is not actuated. Rather, the lever 40 is actuated to cause the actuation device 56 to open the actuation valve 52 and air supply valve 54. After the valves 52, 54 have been opened, the motor 22 operates in reverse and rapidly advances the spindle, as described earlier. When the operator has decided that the tool has rapidly advanced to a sufficient depth, the operator merely releases the lever 40. The lever 40 may be biased to return back to its unactuated position. Because the throttle valve 72 is normally closed at this point, the motor 22 will stop rotating when the lever 40 is returned to its unactuated position.

After the tool has rapidly advanced, and the operator has returned the lever 40 to its unactuated position, the porting to and from the air motor 22 is again changed so that the motor will operate in a forward direction when air is supplied to the motor. This is achieved by the following.

Figure 5:
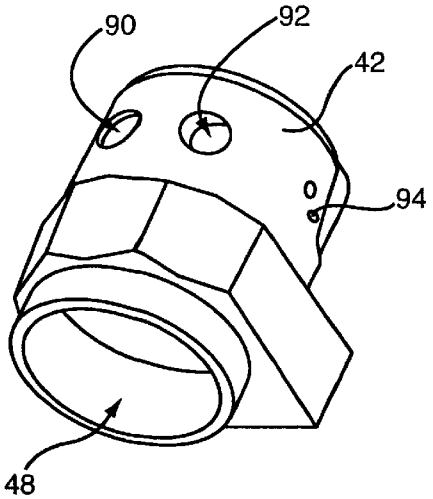
FIG. 5 is a perspective view of a housing of an assembly for reversing an air motor according to one embodiment of the present invention.

As shown in FIGS. 3 and 4, the actuation valve 52 includes a piston 73. The piston 73 is attached to the pin 81. The piston 73 is essential a cylindrical disk-like member that fits tightly within the interior bore of the actuation valve 52, but is movable therein. That is, the piston 73 defines a moveable seal with the interior surface of the bore of the actuation valve 52. The piston 73 preferably blocks the vent channel 88 upon actuation of the actuation but does not block the reversing air channel 60. When the ball 78 of the actuation valve 52 is in the closed position illustrated in FIG. 4, the piston 73 does not obstruct the vent channel 88 and the reversing air channel 60 so that the vent channel 88 and reversing air channel 60 are in communication with each other through the bore of the actuation valve 52. When the lever 40 is actuated, the actuation device 56 causes the pin 81 and the piston 73 to move toward the spring 84. This causes the piston 73 to block the opening into the vent channel 88 in the bore of the actuation valve 52. However, the full movement of the piston 73 in the bore of the actuation valve 52 does not block the reversing air channel 60. Thus, when the piston 73 is fully moved upon actuation of the lever 40, the reversing valve air supply channel 50 and the reversing air channel 60 will remain in communication with each other through the bore of the actuation valve 52. In this manner, air is prevented from venting through the vent channel 88 when the actuation valve 52 is opened. However, when the lever 40 is returned to its unactuated position, the piston 73 returns to the position illustrated in FIG. 4. In this position, the reversing air channel 60 is in communication with the vent channel 88 through the bore of the actuation valve 52. The vent channel 88 is open to atmosphere through a hole 94 in the exterior surface of the housing 42 (see FIG. 5). Thus, the vent channel 88 vents to atmosphere any air in the channel 60 that is at a pressure greater than atmospheric pressure. The pressure adjacent the pneumatically actuated piston 66 and in the reversing air channel 60 will vent to atmosphere through the vent channel 88 after the motor 22 has been reversed and the lever 40 is returned to its unactuated position. Any remaining pressure in the channels 62, 71, 76 between motor 22 and the air supply valve 54 will be quickly dissipated in the air motor 22.

Upon returning the lever 40 back to its unactuated position, the pneumatically actuated piston 66 will return to its original or first location due to the biasing of a spring 70. The piston 66 could also be forced back to its first or original location by pneumatic pressure. The spring 70 ordinarily forces the piston 66 toward the reversing air channel 60 to the first location shown in FIG. 4. In this first location, the piston 66 and dowel pin 68 cause the reversing valve 46 to be located in a first position in which the air motor 22 will operate in a forward direction when air is supplied to the air motor. As described earlier, when air pressure is supplied to the reversing air channel 60, the pressure within the reversing air channel will force the piston 66 to a second location where the piston compresses the spring 70. A vent may be located behind the spring 70 to bleed any air on the spring side of the piston 66. This pneumatically actuated movement of the piston 66 causes the dowel pin 68 to move, which in turn causes the reversing valve 46 to move to a second position in which the normal exhaust port 122 of the air motor 22 then functions as an inlet port so that the air motor will operate in reverse when the air supply valve 54 opens and permits air to flow to the motor.

FIGS. 5–8 illustrate the housing 42 of the air motor reversing assembly 24. As shown in FIGS. 1 and 2, the housing 42 is connected to the air motor 22, as well as a the rear housing 23. The rear housing 23 is connected to the air supply line 21. The housing 42 is not limited to the preferred structure illustrated in the Figures. For example, the housing 42 may be integral with the rear housing 23 such that they are one piece. The air motor 22 is connected to the forward side of the housing 42 while the air supply is routed through the rear side of the housing 42 via the rear housing 23 and air supply line 21. The housing 42 further includes air channel 76 located toward the rear of the housing 42 for supplying air to the motor to operate the motor in a forward direction. The flow of air through the air channel 76 is controlled by the throttle valve 72. As shown in FIGS. 5–8, the housing 42 includes the hollow interior 48 in which the reversing valve 46, rear bearing plate 44, and portions of the air motor 22 are located. The interior 48 specifically defines a cylindrical recess that receives the reversing valve 46 and rear bearing plate 44.

Figure 7:
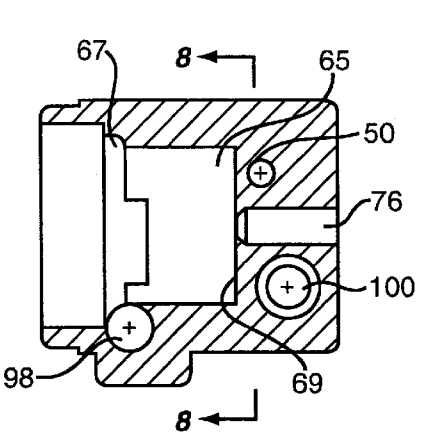
FIG. 7 is a cross-sectional view of the housing of FIG. 5 taken along the line 7—7 of FIG. 6.
Figure 6:
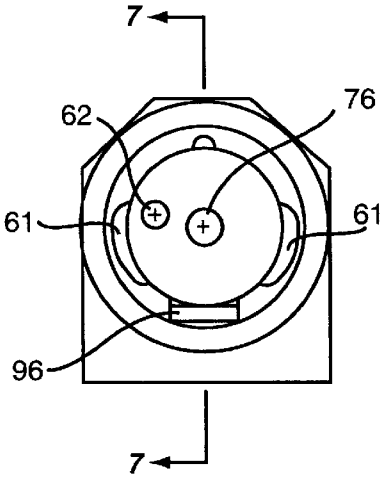
FIG. 6 is an end view of the housing of FIG. 5.
Figure 8:
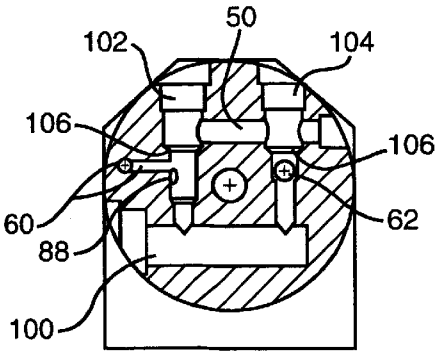
FIG. 8 is a cross-sectional view of the housing of FIG. 5 taken along the line 8—8 of FIG. 7.

The housing 42 includes a bore 90 that defines the location of the air supply valve 54. The housing 42 also includes a bore 92 that defines the location of the actuation valve 52. The bores 90, 92 are located substantially perpendicular to the longitudinal axis of the air motor 22 when the air motor is connected to the housing 42. As shown in FIG. 8, the bores 90, 92 are in communication with each other via the reversing valve air supply channel 50. Each of the bores 90, 92 includes a section 102, 104 having threads (not illustrated) in which a cap 112 is inserted to seal off the bores. As shown in FIG. 7, the bore 90 for the air supply valve 54 is in communication with the reverse air supply channel 62. The channel 62 runs generally perpendicular to the bore 90 and supplies air to the exhaust port 122 of the rear bearing plate 44 so as to turn the motor 22 in reverse. More specifically, the channel 62 opens to a cylindrical space 65 in the interior 48 of the housing 42. When the reversing valve 46 is located in the interior 48, it is located at the position 67 shown in FIG. 7. The reversing valve is prevented from entering the interior any further by a ridge or lip in the interior 48. Thus, there is a space 65 between the back surface 69 and the reversing valve 46. This space or channel 65 generally defines the air supply channel 71 shown in FIG. 4 as both the air channel 76 and the reverse air supply channel 62 open into the space 65. Hence, during forward operation of the motor 22, air will flow through the air channel 76 located along the center axis of the housings 23, 42 to the air supply channel 71, and during reverse operation of the motor 22, air will flow through the channel 62 to the air supply channel 71.

The bore 92 of the actuation valve 52 is penetrated both by the vent channel 88 and the reversing air channel 60. As shown in FIGS. 3 and 8, the opening into the reversing air channel 60 in the bore 92 is located between the vent channel 88 and the reversing valve air supply channel 50. As shown in FIG. 7, the housing 42 also includes a piston bore 98 for receiving the piston 66 of the reversing device 58. The piston bore 98 is in communication with the bore 92 of the actuation valve 52 by the reversing air channel 60 . The housing 42 additionally includes an actuator cylinder bore 100 for receiving at least a portion of the actuation device 56, specifically the cylinder 82.

Figure 10:
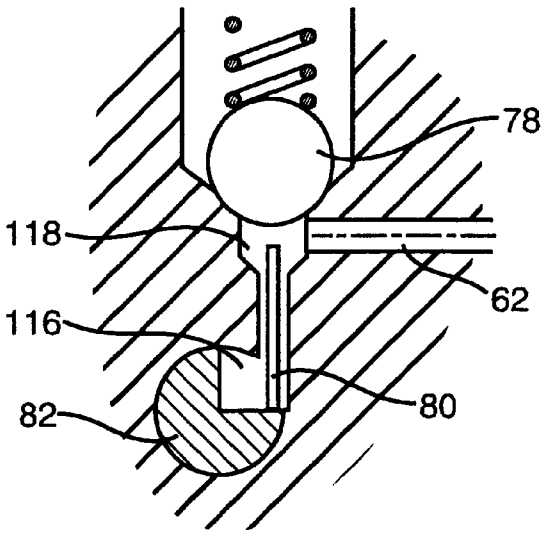
FIG. 10 is a partial cross-sectional view of the assembly for reversing an air motor of FIG. 9 taken along the line 10—10 of FIG. 9.
Figure 9:
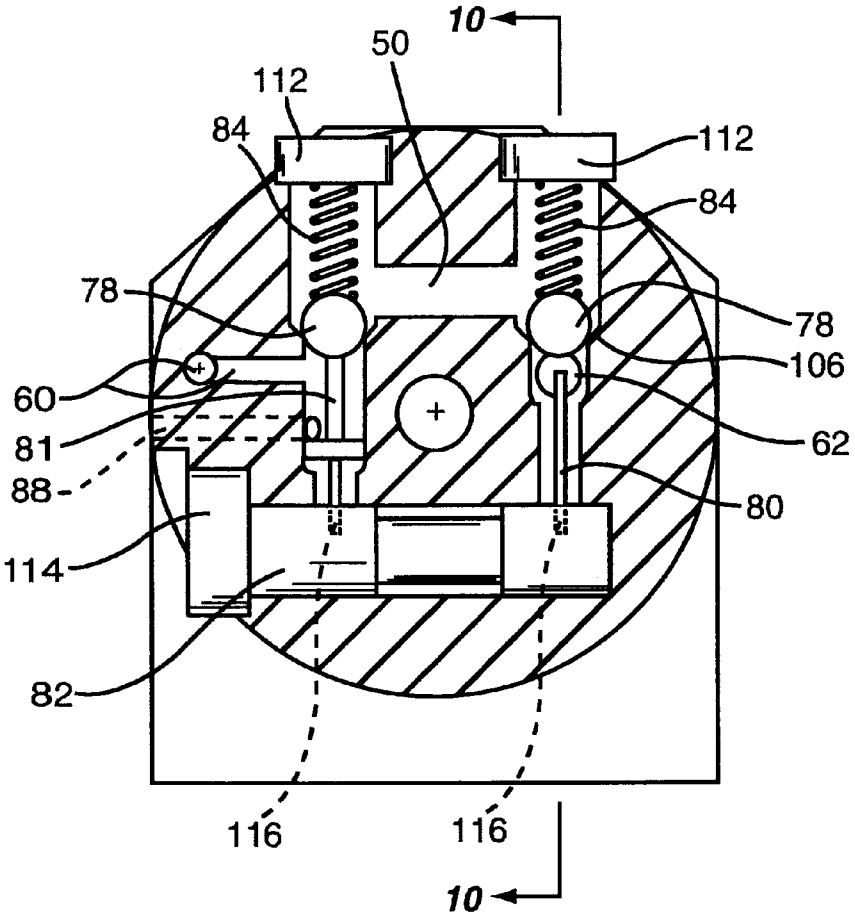
FIG. 9 is a cross-sectional view of the assembly for reversing an air motor of FIG. 1 taken along the line 9—9 of FIG. 1.
Figure 13:
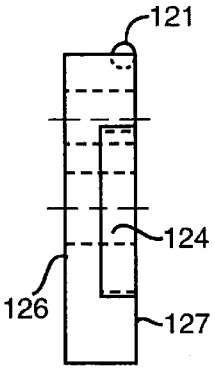
FIG. 13 illustrates a side view of the rear bearing plate of FIG. 12.
Figure 12:
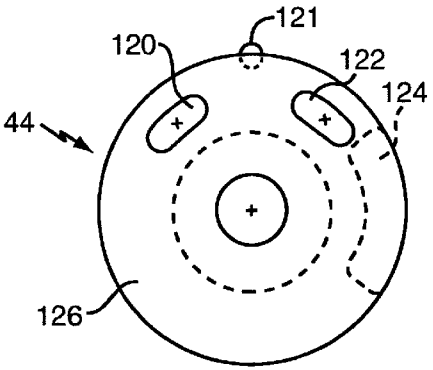
FIG. 12 illustrates a rear bearing plate for use with an assembly for reversing an air motor according to one embodiment of the present invention.

Referring now to FIGS. 9 and 10, the operation of the actuation valve 52 and air supply valve 54 will be explained in further detail. FIG. 9 illustrates a cross-section of the housing 42 with the valves 52, 54 assembled therein. The balls 78 of the valves 52, 54 are biased against the valve seats 106 by springs 84. The springs 84 are placed in a state of compression by the caps 112 that are threaded in the threaded portions 102, 104 illustrated in FIG. 8. As shown in FIG. 9, the balls 78 of the valves 52, 54 each rest against a valve seat such that air flow from the air channel 50 does not enter the air channel 60 or supply passage 62, unless the balls 78 are mechanically lifted off the valve seat to compress the spring 84. The actuation device 56 includes the cylinder 82 shown in FIG. 9. The cylinder 82 is located in the bore 100 and includes two notches or slots 116. The slots 116 are 90° recesses each located along a plane perpendicular to the longitudinal axis of the cylinder 82. Hence, the slots 116 define at least one flat surface on which the dowel pins 80, 81 may rest. The lever 40 is connected to the cylinder 82 by the device 114. Thus, the cylinder 82 will rotate upon actuation of the lever 40. The rotation of the cylinder 82 causes the recesses 116 to rotate with the cylinder, which in turn causes the dowel pins 80, 81 to be lifted upward and press against the balls 78. In this manner the pins 80, 81 lift the balls 78 off of the valve seats 106 against the force of the springs 84.

As shown in FIG. 9, the dowel pin 80 of the air supply valve 54 is shorter than the dowel pin 81 of the actuation valve 52. However, both the slots 116 of the cylinder 82 are located in the same annular position along the circumference cylinder 82 such that the ball 78 of the actuation valve 52 is caused to lift off the valve seat before the ball 78 of the air supply valve 54. That is, because the dowel pin 81 of the actuation valve 52 is longer than the dowel pin 80 of the supply valve 54, the rotation of the cylinder 82 will cause the pin 81 to lift the ball 78 off the valve seat of the actuation valve 52 before the pin 80 lifts the ball 78 off the valve seat of the air supply valve 54. In this manner, the opening o the actuation valve 52 occurs before the actuation of the air supply valve 54.

Although the different length dowel pins 80, 81 are preferred for varying the timing of opening the valves, 52, 54, other means for accomplishing this result are contemplated. For example, the slots 116 in the cylinder 82 may be located at different annular positions about the circumference of the cylinder 82 such that the valves 52, 54 are actuated at different points in time upon rotation of the cylinder 82. Additionally, the pins 80, 81 may be the same length while the respective locations of the balls 78 are staggered relative to each other with respect to the location of the cylinder 82. Furthermore, the actuation device 56 may take other forms. For example, the actuation device may be a cam-like member that lifts the balls 78.

Because the pins 80, 81 have different lengths, an operator of the tool 20 may control the timing of the opening of the first and second valves 52, 54. For example, if the operator moves the lever 40 only a few degrees, the actuation valve 52 will open to reverse the porting to and from the air motor 22. However, due to the different lengths of the pins 80, 81, the air supply valve 54 will not open and the motor will not rotate. Thereafter, the operator need only further advance the lever 40 until the pin 80 moves the ball 78 so that the air supply valve 54 supplies pressurized air to the motor 22 to operate it in reverse. In this manner, an operator may simply and quickly initiate the above-described rapid advance mode of the tool 20 by actuating a single lever 40.

As described earlier, upon actuation of the lever 40, the cylinder 82 will rotate such that the actuation valve 52 and air supply valve 54 are actuated. Although it is preferred that the actuation valve 52 be actuated prior to the actuation of the air supply valve 54, it is contemplated that the valves may be opened simultaneously. Additionally, the air supply valve 54 may be actuated prior to actuation of the actuation valve 52.

Figure 11:
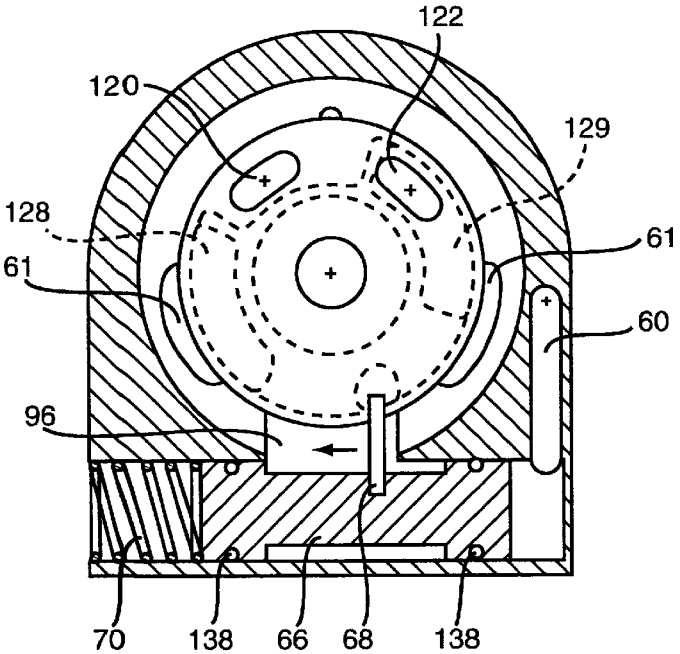
FIG. 11 is a cross-sectional view of the assembly for reversing an air motor of FIG. 1 taken along the line 11—11 of FIG. 1.

FIGS. 11–15 illustrate details of the apparatus for reversing the porting of the air to and from the air motor 22. FIG. 11 illustrates a cross-section of the air motor reversing assembly 24, where the rear bearing plate 44 and reversing valve 46 have been positioned in the interior bore 48 of the housing 42. For purposes of illustration, the air motor 22 has been omitted from the figure.

The rear bearing plate 44 is keyed or pinned to prevent rotation of the rear bearing plate relative to the housing 42. For example, the rear bearing plate includes a drive screw 121 that prevents the rear bearing plate 44 from rotating relative to the housing 42 when it is positioned in the interior bore 48. Hence, the rear bearing plate 44 is stationary with respect to the housing 42, and does not rotate relative thereto. As shown in FIG. 11, the reversing valve 46 is located behind the rear bearing plate 44. The front face 136 of the reversing valve 46 will abut against the rear face 127 of the rear bearing plate 44. The reversing valve 46 rotates relative to the rear bearing plate 44 and hence the housing 42. The rotation of the reversing valve 46 reverses the porting to and from the motor 22 such that the motor 22 will rotate in reverse when air is supplied to the motor.

Figure 15:
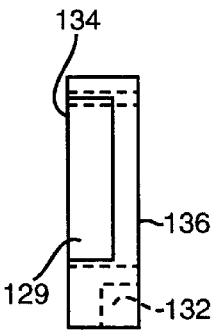
FIG. 15 illustrates a side view of the reversing valve illustrated in FIG. 14.
Figure 14:
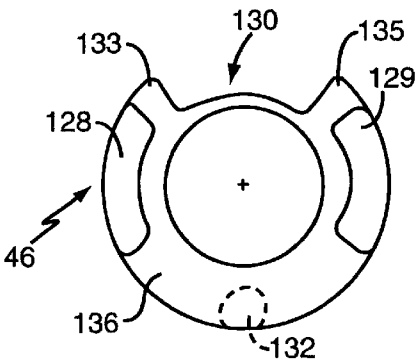
FIG. 14 illustrates a reversing valve for use with an assembly for reversing an air motor according to one embodiment of the present invention.

As shown in FIGS. 14 and 15, the reversing valve 46 is essentially a moveable member that changes the porting of air to and from the ports 120, 122 of the air motor 22. The preferred reversing valve 46 is a rotatable ring or cylinder having at least one air passageway, such as the air supply port 130. The reversing valve 46 may take other forms as well. For example, the reversing valve 46 may be rectangular and have multiple air supply ports. The reversing valve 46 rotates about the longitudinal axis of the air motor 22. The air supply port 130 defines an air supply channel through which pressurized air may flow to the air motor 22 when the air motor is operating in reverse. Additionally, the air supply port 130 defines an air supply channel through which pressurized air may flow to the air motor when the air motor is operated in a forward direction. The reversing valve 46 further includes two exhaust slots or recesses 128, 129 located on opposite sides of the reversing valve 46. The reversing valve 46 further includes a groove 132 that receives the pin 60 connected to the piston 66.

The rear bearing plate 44 of the air motor 22 includes a first air supply channel 120 and a second air supply channel 122. The first air supply channel 120 and the second air supply channel 122 may also be located elsewhere on the motor 22. The first and second air supply channels 120, 122 are kidney shaped ports extending entirely through the rear bearing plate 44. The rear bearing plate 44 further includes an exhaust slot 124 located in the rear face 127 of the rear bearing plate 44, which assists in venting the exhaust from the air motor.

The first air supply channel 120 defines the inlet air flow route for the air motor 22 to operate in a forward direction. When rotating in a the forward direction, the second air supply channel 122 defines at least a portion of the exhaust air flow route for the air motor 22. Conversely, the second air supply channel 122 defines the air supply inlet route for the air motor 22 to rotate in a reverse direction. When rotating in a the reverse direction, the first air supply channel 120 defines at least a portion of the exhaust air flow route for the air motor 22. The porting to and from the air motor 22 is reversed by selectively allowing air to either enter the first air supply channel 120 or the second air supply channel 122 by moving the reversing valve 46.

As illustrated in FIG. 11, the front face 136 of the reversing valve 46 abuts against the rear face 127 of the rear bearing plate 44. The reversing valve 46 is illustrated in FIG. 11 in a first position where the motor 22 will rotate in a forward direction. Specifically, the reversing valve 46 is positioned in its unactuated position. At this position, the first air supply channel 120 is exposed s that air from the air channel 76 will flow into the air supply channel 71 and through the first air supply channel 120 to rotate the air motor in a forward direction. The first protrusion 135 prevents air from flowing into the second passageway 122 from the air supply channel 71. In this position, the exhaust slot 129 of the reversing valve 46 lines up with the second air supply channel 122 of the rear bearing plate 44 so as to receive exhaust air from the air motor 22. The exhaust slot 129 is in communication with an annular exhaust slot 61 in the housing 42 that vents the exhaust air to atmosphere. The air motor 22 also exhausts air through the primary exhaust slots 45 shown in FIG. 2 when the motor is operated in the forward and reverse directions.

When the actuation valve 52 is actuated, pressurized air enters the reversing air channel 60 and forces the piston 66 to move toward the spring 70. In this manner, the piston 66 pneumatically moves. The piston 66 includes O-rings 138 that define a movable seal with an interior surface of the bore 100. As shown in FIG. 11, the piston 66 includes a recess that receives the pin 68. Hence, the pin 68 is connected to the piston 66 and moves when the piston moves. When the actuation valve 52 is opened, the piston 66 moves from the location illustrated in FIG. 11 to a second location toward the spring 70. Because the pin 68 is received by the groove 132 in the reversing valve 46, the reversing valve 46 rotates when the piston 66 is pneumatically actuated. In this manner, the reversing valve 46 is pneumatically actuated or moved. The reversing valve 46 will rotate about the axis of the air motor 22 from the first position illustrated in FIG. 11 to a second position. In the second position, the first air supply channel 120 will be separated from the second air supply channel 122 by the protrusion 133. In this position, the air supply port 130 will communicate the reverse air supply channel 62 and the air supply channel 71 with the second air supply channel 122 of the rear bearing plate 44. Additionally, the exhaust slot 128 will line up with the first air supply channel 120 such that the first air supply channel 120 will now function as an exhaust port for the air motor 22.

After the reversing valve 46 reverses the porting to and from the motor 22, the air supply valve 54 opens to provide air flow to the reverse air supply channel 62 and thus to the second air supply channel 122. Thus, the motor 22 will only operate when the air supply valve 54 is opened, unless the operator has actuated the throttle valve 72. When the motor 22 is rotating in reverse, the first air supply channel 120 will function as an exhaust port, and the exhaust air will travel through the first air supply channel 120, to the exhaust slot 128, to the annular exhaust slot 61, and then around the periphery of the motor to openings in the tool housing to atmosphere.

In the above-described manner, the air motor 22 of the tool 20 may be caused to rotate in a reverse direction. Thus, two steps occur by actuating one lever 40. The first step being reversing the porting of air flow to and from the air motor 22, and the second step being supplying air flow to the air motor 22 to cause it to rotate in reverse. This technique of reversing the air motor 22 is advantageous in that the air motor can be caused to reverse by simply actuating one lever external of the tool 20. That is, an operator need not mechanically change the porting of the air motor with a first device and then turn on the air supply to the air motor with a second device. Rather, the operator can simply actuate one lever to cause the porting to change internally within the tool 20 and then practically simultaneously supply air to the air motor 22 to cause it to rotate in reverse. This is particularly advantageous when used in conjunction with the right angle positive feed drill 20 illustrated in FIG. 1, as an operator may rapidly advance the drill bit with a single actuation step. That is, with the preferred embodiment, only one lever 40 need be actuated to cause the tool to enter into the rapid advance mode.

If an operator of the tool 20 actuates the lever 40 during a drilling cycle of the tool, the valving of the assembly 24 will cause the spindle to slowly retract, rather than rapidly advance toward the workpiece. This occurs because the feed gear 45 is engaged with the main drive gear 43 during the drilling cycle.

The pressurized fluid driving the motor exerts a force on the reversing valve 46, pressing it against the bearing plate 44. Therefore, while the motor is running, the force required to move the reversing valve 46 increases due to the friction between the reversing valve 46 and the bearing plate 44. When the method of returning the piston from the second position to the first position is designed to be insufficient to overcome this force, then the reversing valve will stay in the second position until the fluid supply is closed and the pressure dissipates. This is advantageous because if the lever 40 is inadvertently actuated during the drilling cycle, the motor will shift to reverse and remain in reverse until the supply of fluid is shut off. In this situation, the clutch 37 will prevent damage to the gearing of the tool if the spindle retracts fully before the operator shuts off the tool.

Alternatively, when the method of moving the piston 66 from the second position to the first position is sufficiently strong to move the piston from the second position to the first position when the motor is running, an operator of the tool 20 may activate the lever 40 briefly during a drill cycle. This will cause the spindle to momentarily retract and will break any unusually long machining chips that may be created during drilling, thus improving the efficiency of the drilling operation and improving the quality of the hole produced.

The principles, preferred embodiments and modes of operation of the present invention have been described in the foregoing specification. However, the invention which is intended to be protected is not to be construed as limited to the particular embodiments disclosed. Further, the embodiments described herein are to regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims be embraced thereby.

What is claimed is:

1. An assembly for reversing a fluid driven motor, comprising:

a fluid driven motor;

a throttle valve in communication with a primary fluid flow supply channel located upstream of said throttle valve with respect to a direction of fluid flow, said throttle valve being openable and closeable, said throttle valve for directing fluid flow to said motor from said primary fluid flow supply channel to rotate said motor in a forward direction when said throttle valve is opened;

a reversing valve; and an actuation valve for causing said reversing valve to reverse an inlet port to said motor and an exhaust port from said motor when said actuation valve is actuated, said actuation valve being in communication with said primary fluid supply channel at a location upstream of said throttle valve.

2. The assembly of claim 1 wherein said reversing valve rotates to reverse said inlet port to said motor and said exhaust port from said motor.

3. A method of reversing a fluid driven motor assembly, the fluid driven motor assembly having a first fluid passageway, a second fluid passageway, and a fluid supply channel, the fluid supply channel being in communication with the first fluid passageway when the motor turns in a forward direction, the method comprising:

opening a first valve to operatively connect the fluid supply channel with the second fluid passageway in response to a lever being moved by the user; and opening a second valve to supply fluid flow from the fluid supply channel to the second fluid passageway to turn the fluid driven motor in reverse in response to said lever being moved by the user.

4. The method of claim 3, wherein the second valve is opened after the first valve.

5. The method of claim 3, wherein the reversing of the fluid driven motor causes a right angle feed drill to rapid advance.

6. An assembly comprising:

a fluid driven motor, said motor having a rear bearing plate and a rotor, said rear bearing plate having an inlet port and an exhaust port when said motor rotates in a forward direction; and a fluidly actuated reversing valve, said reversing valve being rotatable about an axis substantially parallel with an axis of said rotor, said reversing valve for directing fluid flow to said exhaust port when said reversing valve is rotated from a first position to a second position, said motor rotating in a reverse direction when fluid flow is supplied to said exhaust port.

7. An assembly for reversing a fluid driven motor operable in a forward direction and a reverse direction, comprising a first valve moveable between an open position and a closed position and controlling the operation of said motor in the forward direction by controlling the flow of fluid to said motor;

a second valve rotatable between a first position corresponding to said forward direction of said motor and a second position corresponding to said reverse direction of said motor;

an actuator controlling the position of said second valve and moveable by a user between first, second, and third positions; and wherein, with said first valve closed, moving said actuator from said first position to said second position causes said second valve to rotate to said second position and moving said actuator from said second position to said third position causes said fluid driven motor to initiate operation in said reverse direction.

8. The assembly of claim 7 further comprising a third valve controlling the supply of at least some pressurized fluid to said fluid driven motor, wherein moving said actuator from said second position to said third position causes said third valve to open, thereby causing said fluid driven motor to initiate operation in said reverse direction.

9. The assembly of claim 7 wherein said second valve comprises a generally round plate disposed substantially within said fluid driven motor and wherein said second actuator comprises a lever moveable by a user between at least said second position and said third position.

10. An assembly for reversing an air motor, comprising:

a housing having an air supply channel;

an air motor having a first air passageway and a second air passageway, said air motor rotating in a first direction when air is supplied to said first air passageway from said air supply channel, said air motor rotating in a second direction opposite to said first direction when air is supplied to said second air passageway from said air supply channel;

a reversing valve, said reversing valve being pneumatically moveable from a first position to a second position, said reversing valve having at least one port that communicates said air supply channel with said first air passageway when said reversing valve is located in said first position, said reversing valve preventing air flow from said air supply channel to said first air passageway and communicating said air supply channel with said second air passageway when said reversing valve is located in said second position;

an openable and closeable actuation valve, said reversing valve moving from said first position to said second position when said actuation valve opens, said reversing valve being moveable from said second position back to said first position when said actuation valve closes;

an openable and closeable air supply valve, said air supply valve communicating said air supply channel with one of said first air passageway and said second air passageway when said air supply valve opens; and an actuation device for opening said actuation valve and for opening said air supply valve.

11. The assembly of claim 10, wherein said air motor includes a rear bearing plate having said first air passageway.

12. The assembly of claim 11, wherein said rear bearing plate includes said second air passageway.

13. The assembly of claim 10, wherein said second air passageway is an exhaust passageway when said motor rotates in said first direction, and said first air passageway is an exhaust passageway when said motor rotates in said second direction.

14. The assembly of claim 10, wherein said air motor is located in a right angle positive feed drill.

15. The assembly of claim 14, wherein said right angle positive feed drill is configured to rapidly advance a spindle when said reversing valve is moved from said first position to said second position.

16. The assembly of claim 10, wherein said housing includes a cavity that receives said reversing valve.

17. The assembly of claim 16, wherein said cavity also receives at least a portion of said air motor.

18. The assembly of claim 10, wherein said port of said reversing valve communicates said air supply channel with said second air passageway when said reversing device is located in said second position.

19. The assembly of claim 10, wherein said reversing valve includes at least one exhaust port for directing exhaust air from the air motor.

20. The assembly of claim 10, further comprising a piston, said piston being pneumatically movable from a first location to a second location upon the opening of said actuation valve, said piston being connected to said reversing valve so that said reversing valve moves from said first position to said second position when said piston is pneumatically moved from said first location to said second location.

21. The assembly of claim 20, wherein said reversing valve, said piston, said actuation valve, and said air supply valve are located in said housing.

22. The assembly of claim 10, wherein said actuation device includes a cylinder and two pins, said pins being at least partially received by recesses in said cylinder, said cylinder being rotatable, said actuation device causing said actuation valve and said air supply valve to open when said cylinder is rotated.

23. The assembly of claim 10, wherein said first air passageway and said second air passageway are at least partially located in a rear bearing plate of said air motor, said reversing valve including a cylindrical plate having said port and at least one exhaust port, said cylindrical plate abutting said rear bearing plate and being rotatable relative to said rear bearing plate.

24. An assembly for reversing a fluid driven motor, comprising:

a fluid driven motor;

a reversing valve for reversing an inlet port to said motor and an exhaust port from said motor;

an openable and closeable actuation valve;

an openable and closeable fluid supply valve; and an actuation device for opening said actuation valve and said fluid supply valve, said actuation valve for causing said reversing valve to reverse the inlet and exhaust porting to and from said fluid driven motor when said actuation device opens said actuation valve, said fluid supply valve for allowing fluid to flow through said fluid supply valve to said motor when said actuation device opens said fluid supply valve, said fluid supply valve for preventing fluid flow through said fluid supply valve to said fluid driven motor when said fluid supply valve is closed.

25. The assembly of claim 24, further comprising a channel that communicates said actuation valve and said fluid supply valve, said fluid supply valve being downstream of said actuation valve with respect to a direction of fluid flow through said channel when said motor is rotating.

26. The assembly of claim 24, wherein said actuation device is configured to open said actuation valve prior to opening said fluid supply valve.

27. The assembly of claim 24, further comprising a housing, said actuation valve, said fluid supply valve, and said reversing valve being at least partially located within said housing.

28. The assembly of claim 24, wherein said actuation device includes two pins of different lengths and a rotatable cylinder having two slots each receiving one of said pins.

29. The assembly of claim 24, wherein said fluid supply valve and said actuation valve each include a moveable ball that abuts against a seat to define a seal.

30. The assembly of claim 24, further comprising a pressure-actuatable piston, said reversing valve including a rotatable cylindrical plate having at least one fluid port, said piston being connected to said cylindrical plate so that said reversing valve rotates when said piston is pressure actuated.

* * * * *